United States Patent [19]

Errichiello

[11] 4,307,972

[45] Dec. 29, 1981

[54] LOOSELEAF BOOKS WITH PLASTIC POSTS

[76] Inventor: Dominic R. Errichiello, 389 Meadowlark Rd., Bloomingdale, Ill. 60108

[21] Appl. No.: 63,543

[22] Filed: Aug. 6, 1979

[51] Int. Cl.[3] ..... B42F 13/00; B42F 13/30

[52] U.S. Cl. ..... 402/73; 402/48; 402/50; 402/52

[58] Field of Search ..... 281/35, 19; 402/48, 402/49, 50, 52, 54, 74, 76, 77, 73, 80 P, 502, 22, 64, 79, 62, 63, 68, 69; 24/47, 67, 67 AR, 67.7, 73 R

[56] References Cited

U.S. PATENT DOCUMENTS

| | | | |
|---|---|---|---|
| 388,402 | 8/1888 | Dodge | 24/47 |
| 776,247 | 11/1904 | Krone | 402/68 |
| 1,728,430 | 9/1929 | Mevi | 281/33 |
| 3,260,264 | 7/1966 | McKowen | 281/29 |
| 3,574,472 | 4/1971 | Cott | 402/80 P |
| 3,612,709 | 10/1971 | Miyamoto | 402/22 |
| 4,180,340 | 12/1979 | Cosby | 402/68 X |

FOREIGN PATENT DOCUMENTS

| | | | |
|---|---|---|---|
| 13740 | of 1899 | United Kingdom | 283/63 A |

OTHER PUBLICATIONS

"Poly-Pro" Polypropylene, Spencer Chemical Co., Kansas City 5, Missouri (1963).

*Primary Examiner*—Paul A. Bell
*Assistant Examiner*—John S. Brown
*Attorney, Agent, or Firm*—Keil & Witherspoon

[57] ABSTRACT

One piece, molded looseleaf books adapted to hold paper sheets with punched holes therein, certain of said books having a spine with front and rear walls and a back wall connected at its longitudinal edges to the front and rear walls by integrally molded living hinges; a rear cover panel and a front cover panel respectively connected to said front and rear walls by a living hinge, a plurality of tubular posts mounted on the rear wall and extending toward the front wall, and a plurality of plugs respectively comprising a stem mounted on the front wall and a head sized and positioned to slidably and frictionally seat in each tubular post when the front and rear walls were pivoted to be substantially parallel; and others of said books being two piece, molded books without a spine between the front and rear cover panels, which have an integrally molded strip connected to each panel by a living hinge, a plurality of posts on the lower strip, and post-penetrated holes on the upper strip.

3 Claims, 4 Drawing Figures

LOOSELEAF BOOKS WITH PLASTIC POSTS

BACKGROUND AND PRIOR ART

The subject invention pertains to improvements in onepiece, molded looseleaf books in which the front and rear cover panels, the optional spine and the parts for removably receiving and holding hole-punched paper sheets, constitute a one-piece molding or two piece moldings of a thermoplastic, synthetic polymer. The most widely used looseleaf book, usually called a looseleaf notebook, uses snap-ring assemblies mounted on the spine of the book, the rings being split and mounted by springable means which allows the split segments of the ring to part in order to add or remove hole-punched paper sheets. Three ring notebooks are well known examples thereof.

Another type of looseleaf book, often used for accounting and financial records, has vertical posts mounted on the rear cover panel or on a strip hingedly connected to said panels, the paper sheets being mounted on the posts. The front cover panel also has a strip hingedly connected thereto, said strip having boltholes therein. Bolts are threaded into tapped upper ends of the posts and removably hold the front cover panel on the posts of the book. Removal of the bolts and the front cover panel allows hole-punched paper sheets to be added to or removed from the book.

Book covers made of plastics are known in the art.—U.S. Pat. No. 3,088,753. Book covers with integrally formed plastic hinges are also known in the art.—Defensive Publication No. 535,843, published Dec. 24, 1968; U.S. Pat. No. 3,168,424; U.S. Pat. No. 3,201,145.

None of the prior art known, to applicant, however, has the concept of one piece, molded looseleaf books in which the punched hole paper-mounting posts and the removable member which coacts with the posts are all part of the same one-piece molding as are the front and rear covers and the spine of the looseleaf book; nor the concepts of the two section, molded, looseleaf books hereinafter described.

BRIEF DESCRIPTION OF THE INVENTION

This invention pertains to looseleaf books comprising a rear cover panel, a front cover panel and a spine in some of said books. The spine has a front, longitudinal strip to which said front cover is hingedly connected by hinge means therebetween, a rear, longitudinal strip to which said rear cover panel is attached, and a back cross wall connected at its opposite longitudinal edges to said rear strip and front strip. Hinge means, preferably integrally molded living hinges, serve as the connection between said cross wall and said front strip. At least one tubular post is mounted on said rear strip and projects toward said front strip. A plug sized to slidably and frictionally fit into said tubular post(s) is mounted on said front strip in position to enter said tubular post(s) as the front strip is pivoted toward a parallel relationship with said rear strip and to exit from said tubular post as said front strip is pivoted away from said rear wall. Equivalent parts such as a solid or hollow post and a hollow, cylindrical collar or a ring sized to fit relatively tightly over the post may be used in lieu of the hollow post-plug combination.

In certain preferred forms of the invention, the posts extend from said rear strip a distance sufficient to serve as a rest stop for said front strip when the latter is pivoted to a position substantially parallel with said rear strip. The cover panels, the spine, the post(s) and the plug(s) preferably are an integral, one piece molding of a synthetic plastic polymer. The hinge means preferably consists of living hinges made of a specially molecularly oriented thermoplastic polymer, e.g., low density polypropylene.

Usually, the looseleaf book has at least two, usually three, of said hollow posts and a corresponding number of said plugs. The posts are spaced longitudinally on said rear strip by distances corresponding to the spacing of holes near an edge of paper sheets to be mounted on said posts when the plugs are removed therefrom. Optionally, the rear strip and the spine's cross wall may be connected by hinge means, and said rear cover panel and said rear strip preferably are connected by hinge means.

Some looseleaf books have two separate, integrally molded front and rear sections. The rear section comprises an integrally molded section having a rear cover panel preferably hingedly connected to a rear strip on which at least one post, usually a plurality of posts, is (are) integrally molded on the rear strip (or rear cover if there is no hinge), and each post projects from said strip at a substantially right angle. The integrally molded front section comprises a front cover panel hingedly connected to a front strip, which has post-receiving holes corresponding in number to the number of posts. The front strip carries about the holes disengageable post-interlocking means for removably mounting the front sections on the post(s).

PREFERRED EMBODIMENTS

Preferred forms of the invention are shown in the drawings, wherein:

IN THE DRAWINGS

Figure 1:
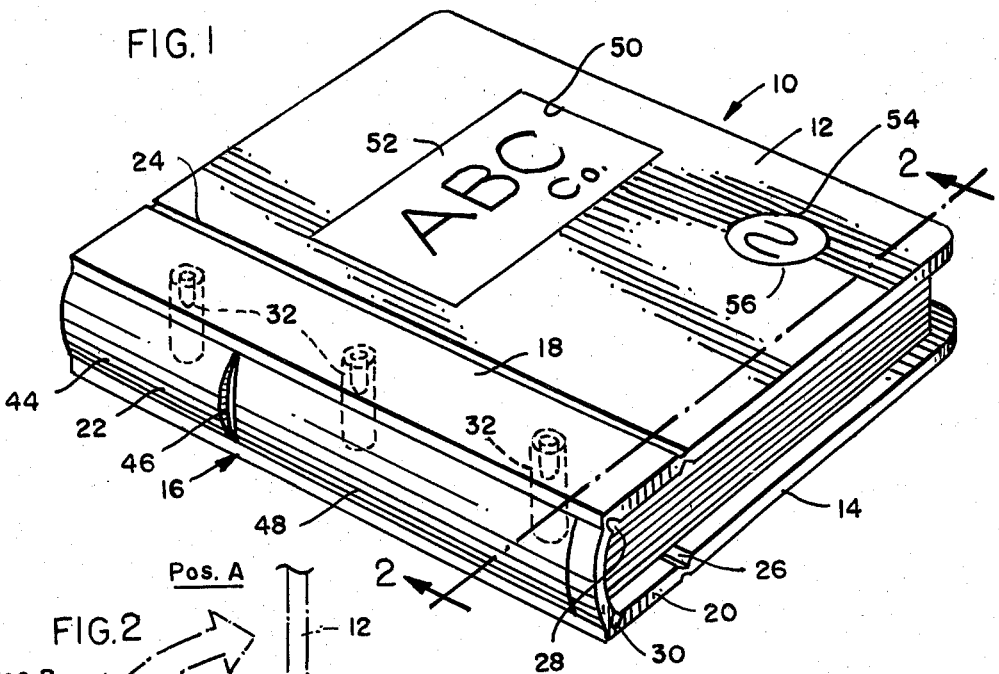
FIG. 1 is a top perspective view of an embodiment of a one piece looseleaf book of the invention.
Figure 2:
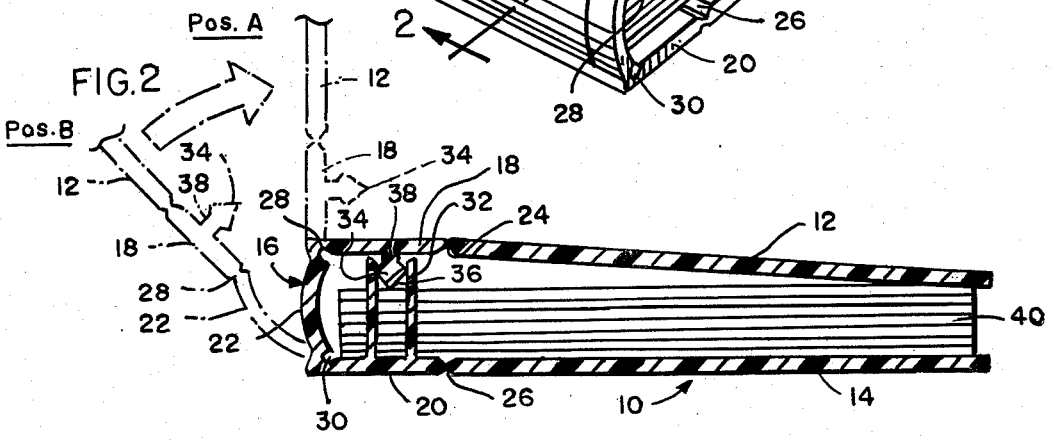
FIG. 2 is a transverse section view taken on section plane 2—2 of FIG. 1.

Referring to the drawings, the looseleaf book 10 of FIGS. 1 and 2 comprises a planar front cover panel 12, a planar rear cover panel 14, and a spine 16. The spine consists of a planar front wall or strip 18, a rear wall or strip 20, and a transversely arched, back, cross wall 22 connected at its opposite longitudinal edges to the rear wall or strip 20 and the front wall or strip 18 by the integrally formed, plastic hinges 30 and 28. The front cover 12 and the rear cover 14 are hingedly connected to the front wall or strip 18 and the rear wall or strip 20 by integrally formed, plastic hinges 24 and 26. As will be apparent from the entire disclosure herein, only the hinge 24 and the hinge 28 are essential to provide an operative, functional looseleaf book. Inclusion of the hinge 26 and/or hinge 30 is preferred but not absolutely essential.

The hinges 24, 26, 28 and 30 comprise a narrow integrally formed, plastic neck serving as a weakened line at which the connected parts can pivot relative to each other. Preferably all of the hinges, but at least the hinge 24, are living hinges made of a molecularly oriented thermoplastic polymer, e.g., low density polypropylene.

The book 10 has at least one, preferably a plurality of, and usually three, integrally molded, plastic posts 32 mounted on the rear wall 20 and projecting toward the front wall 18. The posts 32 may be solid or hollow, depending upon the interfitting means used to frictionally but removably engage the posts. In the illustrated embodiment, the posts 32 are tubular bushings or posts adapted to removably receive and hold the plugs 34. The latter are mounted on the front wall 18 of the spine by integrally molding each plug into a pointed head 36 mounted on the front wall by the stem 38. Other forms for the posts and interfitting means include solid (or hollow) cylindrical posts mounted on the rear wall and hollow, cylindrical collars, rings or the like on the front wall and sized to frictionally fit over the posts.

The posts 34 preferably have a length sufficient to abut against the front wall 18 when the latter is in substantially parallel relationship to the rear wall 20, as is shown in FIG. 2. The front wall 18 then serves as the stop to prevent the paper sheets 40 from accidently being displaced from the posts.

The two positions of the spine and front cover shown in phantom, FIG. 2, show, in Pos. A, the pivoted position of the front wall 18 of the spine and the front cover 12 when the tops of the posts 34 are uncovered to add or remove paper sheets 40 to or from the book. Here only the hinge 28 need be bent, whereby only hinges 24 and 28 are the essential hinges. In Pos. B, the book also needs hinge 30 because the spine's back, cross wall is also pivoted. In this case hinges 24, 28 and 30 are the essential hinges.

Certain aspects of the disclosure herein are disclosed in one or more of my copending applications, i.e., the innovations of one-piece, molded, looseleaf books; books with one or more shallow cavities in the front cover panel and/or the rear face of the spine to receive and frictionally hold molded insert panels with printing or other indicia thereon customized for a particular user or purchaser or identifying the name or type of the book, e.g., looseleaf accounting records, cooking recipes, legal books, medical books, technical books, manuals, etc., where pages are subsequently replaced by updated pages or supplemental pages are added, as in an updated supplement to the initial pages supplied in the looseleaf binding; and a window provided by a hole, optionally covered by a transparent plastic sheet, through the front cover and/or panel spine to read a title or the like.

Thus, the front cover panel 12 may have therein a shallow, large, substantially rectangular cavity 50 in which is mounted a thin, molded, rectangular, panel insert 52 on which is printed in embossed, flat or raised lettering or other indicia, words, symbols, logos, etc. customized to the purchaser's needs and wishes. The panel insert 52 instead may be a window of rectangular shape. By way of illustration, the front cover panel may also have a shallow, circular cavity 54 in which is mounted a thin, molded, insert disc 56 having other indicia, design, etc. Also, the spine wall 22 may be segmented into an upper segment 44 and a lower segment 48. A transverse V-groove 46 hingedly mounts the lower segment 48 of the spine wall 22 for pivotal movement away from the spine strips 18,20 to an angle of about 20° to 40°. The so pivoted lower section 48 can then serve as an easel-like stand when the book 10 is fully opened.

These aspects are disclosed in more detail in my copending application Ser. No. 063,863, filed Aug. 6, 1979, the disclosure of which is incorporated herein by reference as if it had been set forth in its entirety.

Another copending, related application Ser. No. 063,831, filed Aug. 6, 1979, discloses other types of binders, their page-mounting posts and means to hold the front strip of the panel against the upper ends of the page-mounting posts. This disclosure is also incorporated herein by reference.

Figure 3:
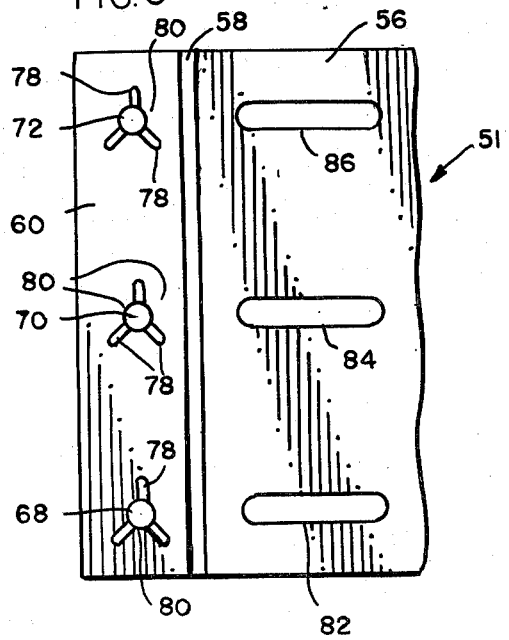
FIG. 3 is a fragmentary, front plan view of a second embodiment of the invention wherein the book is molded in two separate sections.
Figure 4:
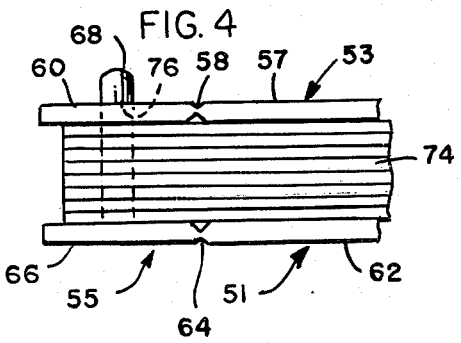
FIG. 4 is a fragmentary side view of the lower side of the embodiment of FIG. 3.

In the embodiment of FIGS. 3 and 4, the spineless looseleaf book 51 is composed of two integral moldings providing a front section 53 and a rear section 55. The front section 53 comprises a front cover panel 57 hingedly connected by the living hinge 58 to the front strip 60. The rear section 55 is composed of a rear cover panel 62 hingedly connected by the living hinge 64 to the rear strip 66.

The rear strip 66 has integrally molded on its inner face a plurality, e.g., three, of hollow or solid posts 68,70,72 which are substantially at right angles of the plane of the inner face. The holes in the hole-punched pages 74 fit over the posts. The front section 53 is mounted removably on the posts by providing in the front strip 60 a plurality of holes 76 of slightly smaller diameters than the diameters of the respective posts 68,70,72. Each hole 76 has a plurality, preferably three, of radial slits on slots 78 intersecting and extending radially away from the periphery of each hole 76. This provides three slightly bendable wings 80 between respective slits on slots 78, which wings flex enough to allow the holes 76 to enlarge enough to pass over the cylindrical posts 68,70,72. Thus, the front strip 76 and its front cover panel 57 are frictionally, but removably, mounted on the posts. The front cover panel 57 optionally has three holes 82,84,86 which are positioned and large enough to pass over respective posts 68,70,72 so that the front cover panel may lie flat against the front strip 60 in the openmost position. These holes may be round, oval, square, oblong, or as shown, elongated slots with semi-circular ends.

It will be appreciated from the foregoing that the invention herein can take many forms other than the preferred forms shown in the drawings and that the invention as herein claimed is not limited to the illustrated embodiments.

I claim:

1. A looseleaf book comprising an integrally molded, thermoplastic polymer, rear section embodying a rear cover panel connected integrally to a rear strip, said rear strip having a plurality of integrally molded thermoplastic polymer posts formed on and projecting at right angles from the inner face of said rear strip; and an integrally molded, thermoplastic polymer, front section embodying a front cover panel hingedly connected by integrally formed hinge means to a front strip, said front strip having a plurality of holes positioned and of a size to fit tightly but removably on the respective posts and also having a plurality of slots extending radially from and intercepting the periphery of each hole to provide flexible wings around each hole to aid the tight fit of said holes about said posts, wherein said posts project through and extend beyond said front strip, and said front cover panel having a number of holes corresponding to the number of posts positioned to lie about the projecting ends of the respective posts when the front cover panel is opened to a position wherein it lies flat against said front strip.

2. A looseleaf book comprising an integrally molded, thermoplastic polymer, rear section embodying a rear cover panel connected integrally to a rear strip, said rear strip having a plurality of integrally molded thermoplastic polymer posts formed on and projecting at right angles from the inner face of said rear strip; and an integrally molded, thermoplastic polymer, front section embodying a front cover panel hingedly connected by integrally formed hinge means to a front strip, said front strip having a plurality of holes positioned and of a size to fit tightly but removably on the respective posts wherein said posts project through and extend beyond said front strip, and said front cover panel having a number of holes corresponding to the number of posts positioned to lie about the projecting ends of the respective posts when the front cover panel is opened to a position wherein it lies flat against said front strip.

3. A looseleaf book as claimed in claims 1 or 2 comprising in addition a hinged member in the rear of said spine which provides an easel-like stand for said looseleaf book.

* * * * *